US010337803B2

(12) United States Patent
Moscatelli

(10) Patent No.: US 10,337,803 B2
(45) Date of Patent: Jul. 2, 2019

(54) DUAL-PHASE FLUID HEATING/COOLING CIRCUIT PROVIDED WITH TEMPERATURE-SENSING FLOW CONTROL VALVES

(71) Applicant: ALENIA AERMACCHI S.p.A., Rome (IT)

(72) Inventor: Antonio Moscatelli, Turin (IT)

(73) Assignee: ALENIA AERMACCHI S.p.A., Rome (IT)

( * ) Notice: Subject to any disclaimer, the term of this patent is extended or adjusted under 35 U.S.C. 154(b) by 692 days.

(21) Appl. No.: 14/526,015

(22) Filed: Oct. 28, 2014

(65) Prior Publication Data

US 2015/0114607 A1 Apr. 30, 2015

(30) Foreign Application Priority Data

Oct. 29, 2013 (IT) ..... TO2013A0873

(51) Int. Cl.
*F28D 15/04* (2006.01)
*F28D 15/02* (2006.01)
*F28D 15/06* (2006.01)

(52) U.S. Cl.
CPC ..... *F28D 15/043* (2013.01); *F28D 15/0266* (2013.01); *F28D 15/06* (2013.01)

(58) Field of Classification Search
CPC ..... F28D 15/043; F28D 15/06
(Continued)

(56) References Cited

U.S. PATENT DOCUMENTS 3,112,890 A 12/1963 Snelling
3,413,819 A * 12/1968 Hansen ..... F17C 13/026 62/222

(Continued)

FOREIGN PATENT DOCUMENTS

EP 1 956 318 A2 8/2008
EP 2 631 183 A1 8/2013

(Continued)

OTHER PUBLICATIONS

Extended European Search Report for corresponding European Patent Application No. 14190625.5 dated Feb. 24, 2015.

(Continued)

*Primary Examiner* — Christopher R Zerphey
*Assistant Examiner* — Paul S Schwarzenberg
(74) *Attorney, Agent, or Firm* — Merchant & Gould P.C.

(57) ABSTRACT

A circuit includes an evaporator receiving heat from a hot body; a condenser transmits heat to a cold body, a working fluid flows through a first conduit in vapour phase from the evaporator to the condenser, and flows through a second conduit in liquid phase, from the condenser to the evaporator. A first evaporator portion is in fluid communication with the second conduit and acts as a compensation chamber. A second evaporator portion is in fluid communication with the first conduit and contains the vapour phase. A porous wick moves the working fluid from the first evaporator portion to the second evaporator portion. A first flow controller interrupts or allows flow when fluid temperature in the elevator is respectively lower or higher than a first threshold. A second flow controller interrupts or allows flow when the temperature in the condenser is respectively higher or lower than a second threshold.

4 Claims, 4 Drawing Sheets

(58) Field of Classification Search
USPC ..... 165/274
See application file for complete search history.

(56) References Cited

U.S. PATENT DOCUMENTS 4,974,667 A * 12/1990 Sun ..... B60H 1/025 165/274
5,257,660 A * 11/1993 Cargile ..... F28D 15/0266 165/104.22
5,816,313 A * 10/1998 Baker ..... F16K 15/048 165/41
6,434,955 B1 * 8/2002 Ng ..... F25B 25/00 62/106
6,442,951 B1 * 9/2002 Maeda ..... F24F 3/1423 62/271
6,591,902 B1 7/2003 Trent
7,877,991 B2 * 2/2011 Miyagawa ..... F01N 5/02 165/41
8,020,613 B2 * 9/2011 Nakakubo ..... F28D 15/0266 165/104.26
8,910,701 B2 * 12/2014 Torres Sep Iveda .... B64G 1/50 165/103
10,123,457 B2 * 11/2018 Hayashi ..... F28F 27/00
2003/0136140 A1 * 7/2003 Maeda ..... F24F 3/1405 62/271
2005/0199016 A1 * 9/2005 Tadano ..... D06F 43/007 68/18 C
2009/0199581 A1 * 8/2009 Ushijima ..... F25B 30/02 62/238.7
2012/0260678 A1 * 10/2012 Yoshida ..... F25B 41/062 62/56
2014/0102130 A1 * 4/2014 Hurtado ..... F25B 1/02 62/502
2019/0011196 A1 * 1/2019 Hoshino ..... F28D 15/025

FOREIGN PATENT DOCUMENTS

JP 2001-165583 A 6/2001
JP 2010-002084 A 1/2010
JP 2011-069546 A 4/2011
JP 2012-042115 A 3/2012
JP 2012042115 A * 3/2012 ..... F28D 15/043
JP 2013-057439 A 3/2013
WO WO 01/51209 A1 7/2001
WO WO 2008/050894 A1 5/2008
WO WO 2010/104431 A1 9/2010
WO WO 2010104431 A1 * 9/2010 ..... F28D 15/0266
WO WO 2011/034472 A1 3/2011

OTHER PUBLICATIONS

Italian Search Report for corresponding Italian Patent Application TO2013A000873 dated Jul. 17, 2014.
Database EPODOC, European Patent Office, The Hague, NL, dated Mar. 28, 2013, XP002727397.
Database EPODOC, European Patent Office, The Hague, NL, dated Mar. 1, 2012, XP002727398.

* cited by examiner

DUAL-PHASE FLUID HEATING/COOLING CIRCUIT PROVIDED WITH TEMPERATURE-SENSING FLOW CONTROL VALVES

This application claims benefit of Ser. No. TO2013A000873, filed 29 Oct. 2013 in Italy and which application is incorporated herein by reference. To the extent appropriate, a claim of priority is made to the above disclosed application.

BACKGROUND OF THE INVENTION

The present invention relates to a two-phase fluid cooling/heating circuit, commonly known as LHP (Loop Heat Pipe) circuit, and more specifically to a two-phase fluid cooling/heating circuit operating in a completely passive manner, i.e. without the aid of motor-driven/controlled components and/or electrical/electronic control systems.

LHP circuits are commonly used in particular in the aerospace field and in the aviation field (in particular military aviation) because of their characteristics of reliability, efficiency, reduced weight and low cost, but in particular because they are completely passive circuits and therefore do not require energy from an external source. As is known, an LHP circuit basically comprises an evaporator device with a first and a second portion which contain, as working fluid, a two-phase fluid and which communicate with each other via a porous wick. In the first portion, which acts as a reservoir or compensation chamber, the fluid is in the liquid phase, while in the second portion, which acts as the actual evaporator and which for this purpose is placed in contact with a body to be cooled (hereinafter referred to as "hot body") so as to receive heat from this body, the fluid is in the vapour phase. The fluid moves by capillarity from the first to the second portion of the evaporator device through the porous baffle and then returns from the second portion back to the first portion flowing along a conduit and passing through a condenser device (made for example as a coil), where the transition from vapour phase to liquid phase takes place. The condenser device may be advantageously used also to release heat to a body to be heated (hereinafter referred to as "cold body"), and therefore the circuit is able to perform both the cooling function and the heating function, transferring heat through the two-phase fluid.

As already mentioned, the movement of the two-phase fluid along the circuit occurs as a result of the capillary thrust the fluid receives as it passes through the porous wick of the evaporator device. There is therefore no need for any pump or other device powered from the outside in order to ensure the flow of the fluid along the circuit, with evident advantages both in terms of manufacturing and operating costs, and in terms of reliability of the system.

Even though in the present description reference will be always made to a hot body and to a cold body, the circuit according to the invention may be equally well used to cool a hot fluid and heat a cold fluid. The terms "hot body" and "cold body" used in the description and in the claims of the present application are therefore to be understood as referring not only to solid bodies, but also to fluids.

EP 2 631 183 A1 discloses a temperature control circuit designed to control the temperatore of a heat source by varying the hydraulic resistance, that is to say, the pressure drop, in the circuit. For this purpose, the control circuit comprises a two-way control valve which controls the flow of the fluid from the evaporator to the condenser in response to the hydraulic resistance, i.e. the pressure drop, in the circuit, and which therefore is not a valve sensitive to the temperature of the two-phase fluid flowing in the circuit. This known control circuit does not comprise other control valves.

JP 2011 069546 A discloses an LHP circuit containing, inside a compensation chamber at the evaporator inlet, a valve which controls the flow of the fluid depending on the temperature in the compensation chamber. During normal operation the valve is closed and therefore causes the fluid to collect in the compensation chamber, while during the start-up phase it is open and therefore causes discharging of the fluid which has collected in the compensation chamber.

JP 2013 057439 A discloses an LHP circuit which, in order to eliminate the air bubbles upstream of the porous baffle to allow initial operation of the circuit, comprises a bellows valve designed to increase the pressure upstream of the porous wick. No further valves, in addition to the bellows valves, are provided for.

JP 2012 042115 A discloses an LHP circuit designed to cool electronic devices arranged in series. In order to allow bypassing of those electronic devices which temporarily do not dissipate heat and therefore do not need to be cooled, pairs of thermal expansion valves are provided for, which valves are designed to deviate the flow of the working fluid from the main circuit to a bypass branch.

WO 2008/050894 A discloses an LHP circuit for controlling the temperature of fuel cells comprising a thermal expansion valve associated with the condenser for controlling the flow of the fluid depending on the temperature.

The control circuits known from the prior art documents discussed above are not designed to keep the temperature of the working fluid (two-phase fluid) within a given range, in particular to keep the minimum temperature of the working fluid (temperature at the condenser) above a given minimum threshold value. Moreover, in order to disassemble the evaporator and the condenser, which are components which must be periodically inspected and cleaned (or replaced), these known control circuits require to empty the circuit of the working fluid contained therein, which results in longer and more expensive maintenance operations.

SUMMARY OF THE INVENTION

It is an object of the present invention to provide a cooling/heating circuit of the aforementioned type, which by means of heat transfer from a hot body to a cold body is able to perform, in a completely passive manner, i.e. without the aid of motor-driven/controlled components and/or electrical/electronic control systems, the following functions: a) to adjust the flow rate of the working fluid so as to keep the temperature of the working fluid within a given temperature range, in particular above a given minimum threshold value; and b) to allow disassembly of the evaporator and/or of the condenser without having to empty the rest of the circuit of the working fluid contained therein.

In short, the invention is based on the idea of providing the circuit with at least two first thermal expansion valves which are placed, respectively, upstream and downstream of the evaporator device, so as to be sensitive to the temperature of the working fluid passing through the evaporator device, and are movable between a closed position and an open position for interrupting or allowing, respectively, in a regulated manner depending on the temperature of the working fluid passing through the evaporator device, the flow of the fluid along the circuit when the temperature of the fluid sensed by these valves is respectively lower or higher than a first threshold value (maximum threshold), and with at least two second thermal expansion valves which are placed, respectively, upstream and downstream of the condenser device, so as to be sensitive to the temperature of the working fluid passing through the condenser device, and are movable between a closed position and an open position for interrupting or allowing, respectively, in a regulated manner depending on the temperature of the working fluid through the condenser device, the flow of the fluid along the circuit when the temperature of the fluid is respectively higher or lower than a second threshold value (minimum threshold) less than the first value.

As will become clear from the following description, the expression "threshold value" is to be understood as meaning not only, or rather not so much, a well-defined temperature value, but rather a given temperature range (which is more or less broad depending on the temperature-sensitivity of the thermal expansion valves) around this temperature value.

Owing to the fact of having first and second thermal expansion valves configured in this way, the circuit according to the invention is able, autonomously and automatically, i.e. without the need for external control, to interrupt the transfer of the heat when the temperature of the working fluid sensed by these valves is within the range between the first and second threshold values and to modulate transfer of the heat when the temperature of the working fluid sensed by these valves is outside this range (i.e. when the maximum temperature of the working fluid is higher than the first threshold value and/or the minimum temperature of the working fluid is lower than the second threshold value). Moreover, when the first thermal expansion valves upstream and downstream of the evaporator device are in the closed position, it is possible to disassemble the section of the circuit arranged between these valves, in order to replace the evaporator device or carry out maintenance operations thereon, without having to empty the entire circuit. Likewise, when the second thermal expansion valves upstream and downstream of the condenser device are in the closed position, it is possible to disassemble the section of the circuit arranged between these valves, for example in order to replace the condenser device or carry out maintenance operations thereon, without having to empty the entire circuit.

The first and second thermal expansion valves used according to the invention for controlling the flow of the working fluid may be of various known types, for example gas valves, liquid valves or bimetallic-strip valves.

BRIEF DESCRIPTION OF THE DRAWINGS

Further features and advantages of the present invention will become clearer from the following detailed description, which is given purely by way of a non-limiting example with reference to the accompanying drawings in which.

DETAILED DESCRIPTION OF THE PREFERRED EMBODIMENTS

Figure 1:
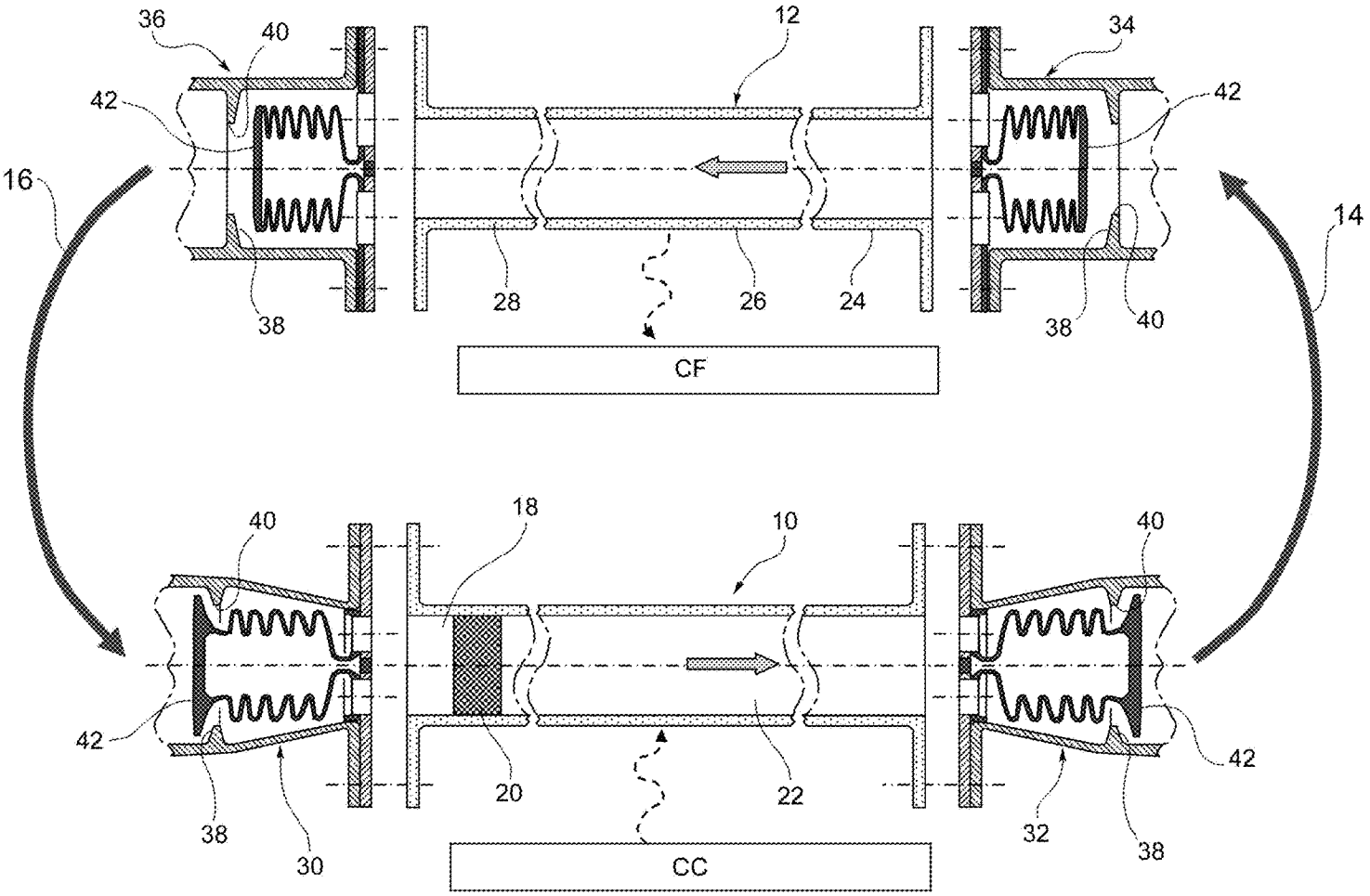
FIG. 1 is a schematic view of a cooling/heating circuit according to the present invention.

FIG. 1 of the accompanying drawings schematically shows a cooling/heating circuit, of the type using a two-phase fluid as working fluid, designed to transfer heat from a hot body (or fluid) CC to a cold body (or fluid) CF so as to keep the temperature of the working fluid within a given range comprised between a first threshold value and a second threshold value less than the first one.

The circuit basically comprises an evaporator device 10 placed in the vicinity of the hot body CC (for example in contact with the latter), a condenser device 12 placed in the vicinity of the cold body CF (for example in contact therewith), a first conduit 14 (schematically designated by means of an arrow which indicates the direction of flow of the fluid) through which the fluid flows from the evaporator device 10 to the condenser device 12, and a second conduit 16 (also schematically designated by means of an arrow which indicates the direction of flow of the fluid) through which the fluid flows from the condenser device 12 to the evaporator device 10. Examples of two-phase fluids which are typically used as working fluids in LHP circuits are water (pure or with added anti-freeze agent), ammonia and propylene, but it is clear that the present invention is not limited to the use of a specific two-phase fluid.

In a manner known per se, the evaporator device 10 comprises in order, in the direction of the flow of the fluid along the circuit, a first evaporator portion 18, a porous baffle 20 and a second evaporator portion 22, whereby the two evaporator portions 18 and 22 communicate with each other through the porous wick 20. The first evaporator portion 18, which is in fluid communication with the second conduit 16, acts as a reservoir or compensation chamber and contains the fluid in liquid phase. The second evaporator portion 22, which is in fluid communication with the first conduit 14, acts as the actual evaporator and contains the fluid in vapour phase. For this purpose, the second evaporator portion 22 is designed to receive heat from the hot body CC, in particular being in contact with this body. As already explained in the introductory part of the description, the fluid moves from the first evaporator portion 18 to the second evaporator portion 22 of the evaporator device 10, and from here along the remaining part of the circuit, and finally returns back to the first evaporator portion 18, as a result of the capillary thrust to which it is subject inside the porous wick 20.

The condenser device 12 comprises in order, in the direction of the flow of the fluid along the circuit, an upstream condenser portion 24, which is in fluid communication with the first conduit 14, an intermediate condenser portion 26, which transmits heat to the cold body CF, being for example in contact with the latter, and a downstream condenser portion 28, which is in fluid communication with the second conduit 16. The intermediate condenser portion 26 may be for example made as a coil, but this is not binding for the purposes of the present invention.

The circuit described above operates therefore as follows.

The fluid in the liquid phase contained in the first evaporator portion 18 of the evaporator device 10 flows by capillarity through the porous wick 20 and reaches the second evaporator portion 22 where, as a result of the heat received from the hot body CC, it passes into the vapour phase. The fluid in vapour phase then flows from the evaporator device 10 to the condenser device 12 along the first conduit 14. When flowing through the condenser device 12, in particular through the intermediate condenser portion 26, the fluid releases heat and thus passes from the vapour phase to the liquid phase, and finally returns again, through the second conduit 16, to the first evaporator portion 18 of the evaporator device 10.

According to the invention, the cooling/heating circuit further comprises first flow control means which are sensitive to the temperature of the fluid through the evaporator device 10 and are configured to interrupt or allow, in a regulated manner depending on the temperature of the fluid sensed by them, the fluid flow along the circuit when the temperature of the fluid sensed by them is respectively lower or higher than the first threshold value, and second flow control means which are sensitive to the temperature of the fluid through the condenser device 12 and are configured to interrupt or allow, in a regulated manner depending on the temperature of the fluid sensed by them, the flow of the fluid along the circuit when the temperature of the fluid sensed by them is respectively higher or lower than the second threshold value.

The first flow control means comprise at least two first thermal expansion valves, indicated 30 and 32, respectively, which are placed respectively upstream and downstream of the evaporator device 10, so as to be sensitive to the temperature of the fluid through said device, in order to control the fluid flow along the circuit depending on the temperature sensed by them. More specifically, the valve 30 is arranged between the second conduit 16 and the first evaporator portion 18 of the evaporator device 10, while the valve 32 is arranged between the second evaporator portion 22 and the first conduit 14. Each of the valves 30 and 32 is movable between an open position and a closed position, where it respectively allows and prevents the flow of the fluid through it, the movement from one position to the other depending on the temperature of the fluid through the evaporator device sensed by the valve. More particularly, the valves 30 and 32 are of the so-called "hot-opening type", in that the movement from the closed position to the open position occurs when the temperature of the fluid through the evaporator device sensed by the valve is higher than the aforementioned first threshold value. Opening of the valves 30 and 32 allows the working fluid to flow from the evaporator device 10 to the condenser device 12 and therefore to cool. The circuit is thus able to pass autonomously and automatically, depending on the temperature of the fluid sensed by the valve 30 and/or by the valve 32, from the open condition, where the fluid flows along the circuit and therefore performs the heat transfer action, to the closed condition, where there is no flow along the circuit and therefore the heat transfer action is interrupted.

The fact of providing (at least) one valve upstream and (at least) one valve downstream of the evaporator device 10 offers the advantage that, when these valves are simultaneously closed, the evaporator device may be disassembled for replacement or for carrying out maintenance operations thereon, without having to empty the entire circuit.

The second temperature-sensitive flow control means comprise at least two second thermal expansion valves, indicated 34 and 36, respectively, which are placed respectively upstream and downstream of the condenser device 12, so as to be sensitive to the temperature of the fluid through said device, in order to control the fluid flow along the circuit depending on the temperature sensed by them. More specifically, the valve 34 is arranged between the first conduit 14 and the upstream condenser portion 24 of the condenser device 12, while the valve 36 is arranged between the downstream condenser portion 28 and the second conduit 16. Each of the valves 34 and 36 is movable between an open position and a closed position, where it respectively allows and prevents the flow of the fluid through it, the movement from one position to the other depending on the temperature of the fluid through the condenser device sensed by the valve. More particularly, the valves 34 and 36 are of the so-called "cold-opening type", in that the movement from the closed position to the open position occurs when the temperature of the fluid sensed by the valve is lower than the aforementioned second threshold value. Opening of the valves 34 and 36 allows the working fluid to flow from the condenser device 12 to the evaporator device 10, and therefore to heat up, which ensures that the minimum temperature of the fluid in the circuit is kept above the second threshold value. The circuit is thus able to pass autonomously and automatically, depending on the temperature of the fluid sensed by the valve 34 and/or by the valve 36, from the open condition, where the fluid flows along the circuit and therefore performs the heat transfer function, to the closed condition, where there is no flow along the circuit and therefore the heat transfer function is interrupted.

The fact of providing (at least) one valve upstream and (at least) one valve downstream of the condenser device 12 offers the advantage that, when these valves are both closed, the evaporator device may be disassembled for replacement or for carrying out maintenance operations thereon, without having to empty the entire circuit.

FIGS. 2 to 7*b* of the accompanying drawings show a number of examples of thermal expansion valves which may be used as first and second temperature-sensitive flow control means in the circuit according to the invention, it being clear that these examples are to be understood as being purely illustrative and not limiting the present invention.

Figure 3:
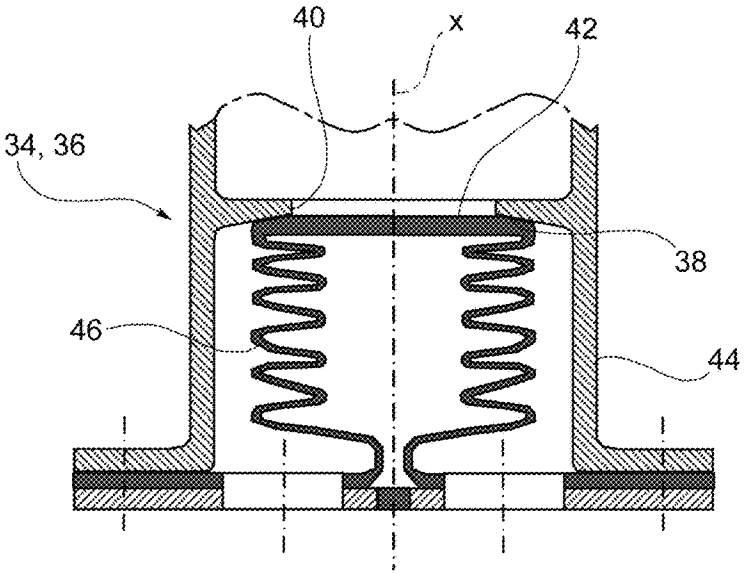
FIGS. 2 and 3 are cross-sectional views of two examples of gas-type thermal expansion valves, of the type that opens when heated and of the type that opens when cooled, respectively, which can be used in a two-phase fluid cooling/heating circuit according to the present invention.
Figure 2:
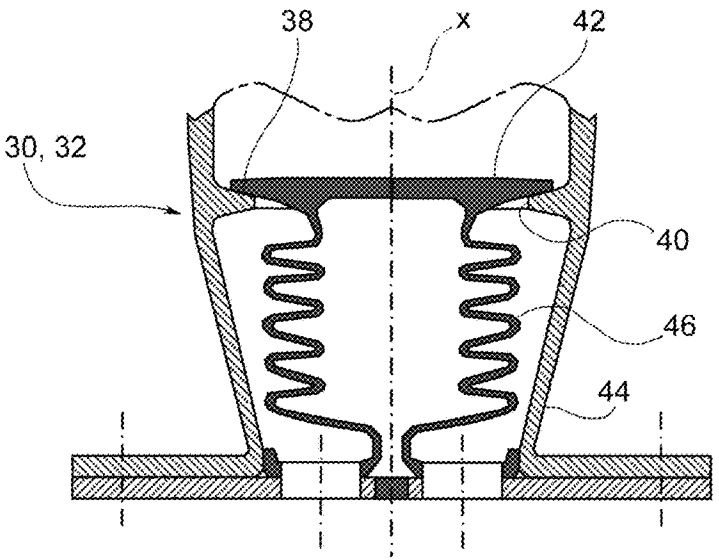

In the examples shown in FIGS. 2 and 3, the thermal expansion valves are gas valves. More specifically, FIG. 2 shows the hot-opening version, intended to be used for the first valves 30 and 32 associated with the evaporator device 10, while FIG. 3 shows the cold-opening version, intended to be used for the second valves 34 and 36 associated with the condenser device 12.

Figure 5:
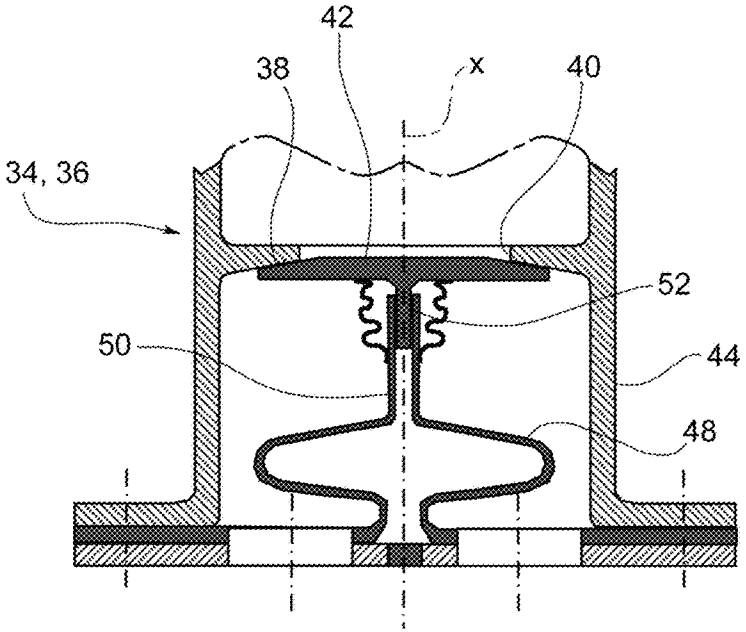
FIGS. 4 and 5 are cross-sectional views of two examples of liquid-type thermal expansion valves, of the type that opens when heated and of the type that opens when cooled, respectively, which can be used in a two-phase fluid cooling/heating circuit according to the present invention.
Figure 4:
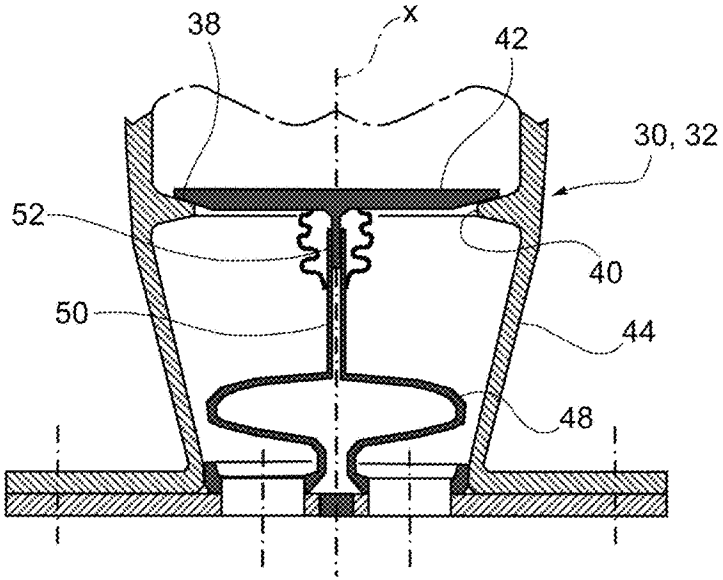
Figure 6:
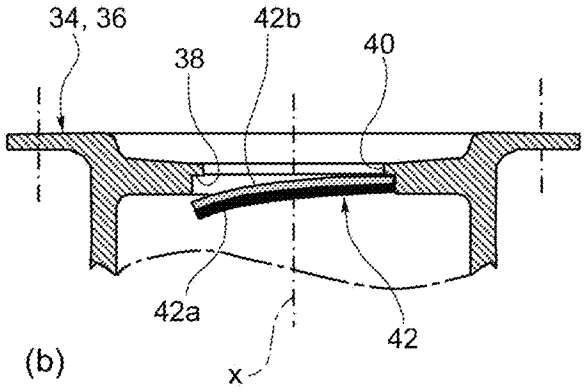
FIGS. 6*a*, 6*b* and 7*a*, 7*b* are cross-sectional views of two examples of bimetallic strip thermal expansion valves, of the type that opens when heated and of the type that opens when cooled, respectively, which can be used in a two-phase fluid cooling/heating circuit according to the present invention, each of the two valve types being shown both in the closed position and in the open position.
Figure 6:
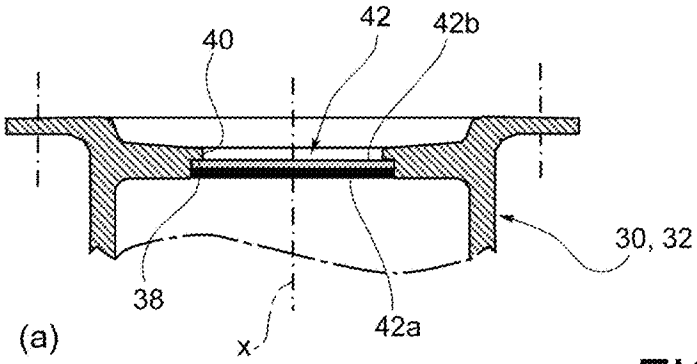

In the examples shown in FIGS. 4 and 5, the thermal expansion valves are liquid valves. More specifically, FIG. 4 shows the hot-opening version, intended to be used for the first valves 30 and 32 associated with the evaporator device 10, while FIG. 5 shows the cold-opening version, intended to be used for the second valves 34 and 36 associated with the condenser device 12.

Finally, in the examples shown in FIGS. 6*a*, 6*b* and 7*a*, 7*b*, the thermal expansion valves are bimetallic-strip valves. More specifically, FIGS. 6*a* and 6*b* show the hot-opening version, in the closed position (FIG. 6*a*) and in the open position (FIG. 6*b*), respectively, which version is intended to be used for the first valves 30 and 32 associated with the evaporator device 10, while FIGS. 7*a* and 7*b* show the cold-opening version, in the closed position (FIG. 7*a*) and in the open position (FIG. 7*b*), respectively, which version is intended to be used for the second valves 34 and 36 associated with the condenser device 12.

Figure 7:
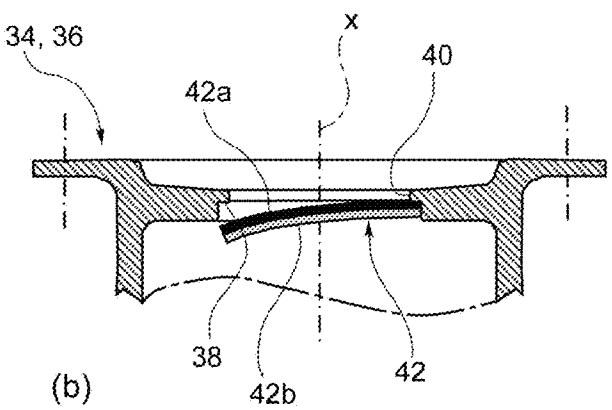
Figure 7:
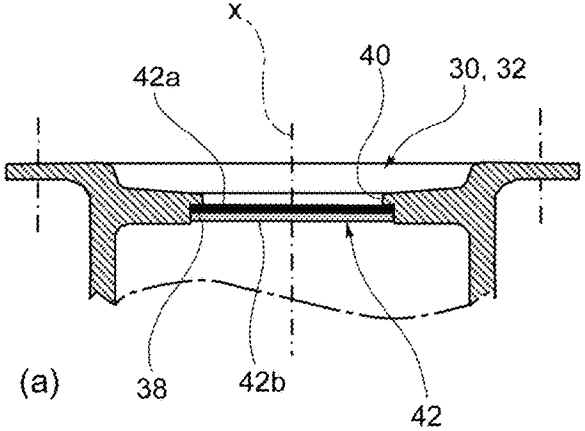

All the valve types shown in FIGS. 2 to 7*b* basically comprise a valve seat 38 which delimits a flow passage opening 40, intended to be passed through by the working fluid, and a closing member 42 which controls the flow of the working fluid through the flow passage opening 40 depending on the temperature sensed by the valve. In the closed position of the valve, as shown in FIGS. 2, 3, 4, 5, 6*a* and 7*a*, the closing member 42 bears against the valve seat 38 and prevents therefore the flow of the working fluid through the flow passage opening 40. In the open position of the valve, as shown in FIGS. 1, 6*b* and 7*b*, the closing member 42 is spaced from the valve seat 38 and thus allows the flow of the working fluid through the flow passage opening 40. The position of the closing member 42 depends on the temperature sensed by the valve (temperature of the working fluid), as will be explained in detail hereinbelow.

According to the embodiment of FIGS. 2 and 3, the valve further comprises a valve body 44 forming the valve seat 38 and a bellows 46 able to expand/contract in an axial direction x parallel to the direction of the fluid flow through the valve. The bellows 46 is rigidly connected, directly or indirectly, at an end thereof (top end) to the closing member 42 and at the opposite end to the valve body 44, in such a way that expansion and contraction of the bellows 46 produce a movement of the closing member 42 with respect to the valve seat 38 in the axial direction x. The bellows 46 is filled with a gas and therefore its volume varies depending on the temperature in accordance with the following equation:

$$\Delta V=(n\cdot R/p)\cdot\Delta T, \tag{1}$$

where ΔV is the change in volume of the bellows (equal to that of the gas contained inside it), n is the number of moles of gas contained in the bellows, R is the universal constant of the gases, p is the pressure of the gas (which may be regarded as being constant since it is associated with the characteristics of the bellows) and ΔT is the change in temperature.

Since the change in volume ΔV of the bellows is equal to the product of the area A of the top end of the bellows on which the gas exerts its pressure for the axial displacement S of the top end of the bellows, it follows that the relation between the displacement S and the change in temperature ΔT is as follows:

$$S=(n\cdot R/p)\cdot\Delta T/A. \tag{2}$$

Assuming a number of moles n equal to 0.01, a pressure p equal to 1.5 bar and an area A equal to 2 $cm^2$, a change in temperature ΔT of 20° C. results in a displacement S of about 5.5 cm. The gas valves are therefore very sensitive to changes in temperature.

In the version shown in FIG. 2, the closing member 42 is axially arranged on the opposite side to the bellows 46 relative to the valve seat 38, with the result that the expansion of the bellows due to the increase in temperature of the working fluid, and therefore of the gas contained inside the bellows, causes the movement of the closing member 42 away from the valve seat 38, and therefore the flow of the fluid through the flow passage opening 40. This type of valve is therefore intended to be used in combination with the evaporator device 10, as shown in FIG. 1.

On the other hand, in the version shown in FIG. 3, the closing member 42 is axially arranged on the same side as the bellows 46 relative to the valve seat 38, with the result that the expansion of the bellows due to the increase in temperature of the working fluid, and therefore of the gas contained inside the bellows, causes the movement of the closing member 42 towards the valve seat 38, and therefore closing of the flow passage opening 40. This type of valve is therefore intended to be used in combination with the condenser device 12, as shown in FIG. 1.

According to the embodiment shown in FIGS. 4 and 5, the valve further comprises a valve body (herein indicated 44 too) forming the valve seat 38 and a reservoir 48 filled with a liquid and constrained to the valve body 44. The reservoir 48 terminates in a cylindrical neck 50 which extends along the axial direction x, a rod 52 rigidly connected to the closing member 42 being slidably received in the cylindrical neck 50, whereby a variation in the volume of the liquid contained in the reservoir 48 in response to a change in temperature produces an axial displacement of the rod 52 with respect to the reservoir 48, and therefore an axial displacement of the closing member 42 with respect to the valve seat 38. In this case, the relation between the displacement S of the closing member and the change in temperature ΔT is as follows:

$$S=(\alpha_{liq}-3\cdot\lambda_{met})\cdot V\cdot\Delta T/A, \tag{3}$$

where $\alpha_{liq}$ is the coefficient of volumetric expansion of the liquid, $\lambda_{met}$ is the coefficient of linear expansion of the metal from which the reservoir is made, V is the volume of the reservoir and A is the cross-sectional area of the cylindrical neck of the reservoir.

Assuming that a stainless reservoir is used ($\lambda_{met}$=0.0000096 1/° C.), with a volume of 0.01 1 and a cross-sectional area of the neck equal to 0.3 $cm^2$, and that the reservoir is filled with silicone oil ($\alpha_{liq}$=0.0016 1/° C.), a change in temperature ΔT of 20° C. results in a displacement S equal to about 1 cm. Liquid valves are therefore less sensitive to changes in temperature than the gas valves described above with reference to FIGS. 2 and 3, in that the same change in temperature results in a displacement of the closing member that is smaller than that of the gas valves.

In the version shown in FIG. 4, the closing member 42 is axially arranged on the opposite side to the reservoir 48 relative to the valve seat 38, with the result that the outward movement of the rod 52 due to the increase in temperature of the working fluid, and therefore of the liquid contained inside the reservoir, causes the movement of the closing member 42 away from the valve seat 38, and therefore the flow of the fluid through the flow passage opening 40. This type of valve is therefore intended to be used in combination with the evaporator device 10.

On the other hand, in the version shown in FIG. 5, the closing member 42 is axially arranged on the same side as the reservoir 48 relative to the valve seat 38, with the result that the outward movement of the rod 52 due to the increase in temperature of the working fluid, and therefore of the liquid contained inside the reservoir, causes the movement of the closing member 42 towards the valve seat 38, and therefore closing of the flow passage opening 40. This type of valve is therefore intended to be used in combination with the condenser device 12.

Finally, FIGS. 6*a*, 6*b* and 7*a*, 7*b* show examples of thermal expansion valves that can be used in a circuit according to the invention, wherein the closing member 42 has a rectangular shape and is made as a bimetallic strip, with a first strip portion 42*a* made of a first metal and with a second strip portion 42*b* which is attached to the first strip portion 42*a* and is made of a second metal having a higher thermal expansion coefficient than that of the first metal. More specifically, the closing member 42 is attached with a first edge thereof to the valve seat 38, while the opposite edge is free to move with respect to the valve seat 38 as a result of deformation of the closing member due to a change in temperature.

More specifically, FIGS. 6*a* and 6*b* show, in the closed position and in the open position, respectively, a valve of the hot-opening type. In this case, at low temperatures (FIG. 6*a*), i.e. below a given threshold temperature value, the bimetallic strip is undeformed and therefore the free edge of the closing member 42 makes contact with the valve seat 38 and closes the flow passage opening 40. At high temperatures, i.e. above the aforementioned temperature threshold value, the bimetallic strip is deformed and therefore the free edge of the closing member 42 is caused to move away from the valve seat 38, which results in opening of the valve.

FIGS. 7*a* and 7*b* instead show, in the closed position and in the open position, respectively, a valve of the cold-opening type. In this case, at high temperatures (FIG. 7*a*), i.e. above a given threshold temperature value, the bimetallic strip is undeformed and therefore the free edge of the closing member 42 makes contact with the valve seat 38 and closes the flow passage opening 40. At low temperatures, instead, i.e. at a temperature lower than the aforementioned threshold value, the bimetallic strip is deformed and therefore the free edge of the closing member 42 is caused to move away from the valve seat 38, which results in opening of the valve.

Assuming that a bimetallic strip is used having a first strip portion made of Invar alloy (63.8 Fe; 36 Ni; 0.2 C), with a thermal expansion coefficient of 0.000001 1/° C., and a second strip portion made of brass (60 Cu; 40 Zn), with a thermal expansion coefficient of 0.000021 1/° C., with a length of 50 mm and a thickness of 0.5 mm, based on simple calculations the displacement of the free edge of the strip resulting from a change in temperature of 20° C. is equal to 1 mm, and therefore of an order of magnitude smaller than that calculated above with reference to an example of liquid valve. Bimetallic-strip valves are therefore even less sensitive to temperature variations than liquid valves.

In the light of the above description, the advantages which may be achieved with the present invention are evident.

First of all, use of the first and second thermal expansion valves allows optimization of the circuit operation, since the function of modulated heat transfer is automatically activated and deactivated in a completely passive manner depending on the actual temperature of the working fluid, which temperature is thus maintained within a predefined range comprised between the first and second threshold values.

Secondly, since the first and second thermal expansion valves are arranged respectively upstream and downstream of the evaporator device and upstream and downstream of the condenser device, it is possible, in the condition where these valves close the circuit both upstream and downstream of the respective evaporator or condenser device, to disassemble this device, for example for maintenance purposes, without having to empty the entire circuit, with obvious advantages in terms of shorter times and lower costs for maintenance. Naturally, the principle of the invention remaining unchanged, the embodiments and the constructional details may be greatly modified with respect to those described and illustrated purely by way of a non-limiting example.

For example, even if the embodiment illustrated herein has exactly two thermal expansion valves associated with the evaporator device and two thermal expansion valves associated with the condenser device, further thermal expansion valves could be envisaged provided that there is at least one valve upstream and at least one valve downstream both of the evaporator device and of the condenser device.

What is claimed is:

1. A passively-operating heating/cooling circuit designed to transfer heat from a hot body to a cold body using a two-phase fluid as the working fluid, the circuit comprising:

an evaporator device adapted to receive heat from the hot body;

a condenser device adapted to transmit heat to the cold body;

a first conduit through which the working fluid, in vapour phase, flows from the evaporator device to the condenser device; and a second conduit through which the working fluid, in liquid phase, flows from the condenser device to the evaporator device;

wherein the evaporator device comprises a first evaporator portion, which is in fluid communication with the second conduit and acts as a reservoir or compensation chamber containing the working fluid in liquid phase, a second evaporator portion, which is in fluid communication with the first conduit and contains the working fluid in vapour phase, and a porous wick arranged between the first and second evaporator portions to move the working fluid by capillarity from the first evaporator portion to the second evaporator portion through the porous wick;

at least one first passive thermal expansion valve placed upstream of the evaporator device and at least one first passive thermal expansion valve placed downstream of the evaporator device, said first passive thermal expansion valves being sensitive to the temperature of the working fluid through the evaporator device and being automatically movable without external control between a closed position, in which said first passive thermal expansion valves interrupt flow of the working fluid along the circuit when the temperature of the working fluid sensed by said first passive thermal expansion valves is lower than a first threshold value, and an open position, in which said first passive thermal expansion valves adjust the flow of the working fluid along the circuit depending on the temperature of the working fluid sensed by said first passive thermal expansion valves, when said temperature is higher than said first threshold value, and at least one second passive thermal expansion valve placed upstream of the condenser device and at least one second passive thermal expansion valve placed downstream of the condenser device, said second passive thermal expansion valves being sensitive to the temperature of the working fluid through the condenser device and being automatically movable without external control between a closed position, in which said second passive thermal expansion valves interrupt the flow of the working fluid along the circuit when the temperature of the working fluid sensed by said second passive thermal expansion valves is higher than a second threshold value less than the first threshold value, and an open position, in which said second passive thermal expansion valves adjust the flow of the working fluid along the circuit depending on the temperature of the working fluid sensed by said second passive thermal expansion valves, when said temperature is lower than said second threshold value, each of said first and second passive thermal expansion valves comprising:

a valve seat delimiting a fluid passage opening through which the working fluid flows, a closer controlling the flow of the working fluid through the fluid passage opening, the closer being movable relative to the valve seat between an open position and a closed position; and a controller connected to the closer, the controller being in direct contact with the working fluid and moving the closer between said open position and said closed position depending on temperature of the working fluid contacting the controller.

2. The passively-operating heating/cooling circuit according to claim 1, wherein each of said first and second passive thermal expansion valves further comprises a valve body forming the valve seat and a bellows forming the controller; the bellows configured to expand and contract in an axial direction parallel to the direction of the flow of the working fluid through the valve, the bellows being filled with gas and being rigidly connected at a top end to the closer and at the opposite end to the valve body, wherein expansion and contraction of the bellows due to a change in volume of the gas in response to a change in temperature cause movement of the closer relative to the valve seat in said axial direction.

3. The passively-operating heating/cooling circuit according to claim 1, wherein each of said first and second passive thermal expansion valves further comprises a valve body forming the valve seat and a reservoir filled with a liquid and constrained to the valve body, the reservoir ending with a neck which extends along an axial direction parallel to the direction of the flow of the working fluid through the valve, and a rod rigidly connected to the closer being slidably received in the neck, wherein a change in volume of the liquid contained in the reservoir in response to a change in temperature causes an axial movement of the rod relative to the reservoir, and an axial movement of the closer relative to the valve seat.

4. The passively-operating heating/cooling circuit according to claim 1, wherein the closer of each of said first and second passive thermal expansion valves is made as a bimetallic strip, with a first strip portion made of a first metal and with a second strip portion which is attached to the first strip portion and is made of a second metal having a higher thermal expansion coefficient than a thermal expansion coefficient of the first metal, and wherein the closer is attached at a first edge to the valve seat, and an opposite edge is free to move relative to the valve seat as a result of a deformation of the closer due to a change in temperature.

* * * * *